US005348120A

United States Patent [19]

Junk et al.

[11] Patent Number: 5,348,120

[45] Date of Patent: Sep. 20, 1994

[54] RAIL LUBRICATION APPARATUS

[75] Inventors: Ronald K. Junk, Cabot; William T. Urmson, Jr., Valencia; Thomas R. Walker, Mars, all of Pa.

[73] Assignee: Portec Inc., Oak Brook, Ill.

[21] Appl. No.: 995,546

[22] Filed: Dec. 22, 1992

Related U.S. Application Data

[63] Continuation of Ser. No. 687,360, Apr. 18, 1991, abandoned.

[51] Int. Cl.[5] ..... B61K 3/00

[52] U.S. Cl. ..... 184/3.1; 104/279; 238/338; 248/228

[58] Field of Search ..... 184/2, 3.1, 3.2; 104/279; 198/500; 238/338; 246/169 R, 193, 249; 248/228, 316.1

[56] References Cited

U.S. PATENT DOCUMENTS

| | | | |
|---|---|---|---|
| 843,918 | 2/1907 | Wallace | 238/338 |
| 1,489,104 | 4/1924 | Armington | 248/228 |
| 1,707,016 | 3/1929 | Keim | 104/279 |
| 1,880,672 | 10/1932 | Bates et al. | 184/3.1 |
| 1,888,678 | 11/1932 | Keim | 184/3.1 |
| 1,979,307 | 11/1934 | Bates | 184/3.1 |
| 2,168,554 | 8/1939 | Bates | 184/3.1 |
| 2,168,577 | 8/1939 | Overmier et al. | 184/3.1 |
| 2,183,727 | 12/1939 | Stern | 184/3.1 |
| 2,223,714 | 12/1940 | Bates et al. | 184/3.1 |
| 2,231,394 | 2/1941 | Reece | 184/3.1 |
| 2,285,082 | 6/1942 | Bolt | 184/3.1 |
| 2,664,113 | 12/1953 | Dodge | 248/228 |
| 2,884,093 | 4/1959 | Stewart | 184/3.1 |
| 2,929,466 | 3/1960 | McWilliams | 184/3.1 |
| 3,147,822 | 9/1964 | Watts | 184/3.1 |
| 3,210,539 | 10/1965 | Malaquin | 246/249 |

FOREIGN PATENT DOCUMENTS

| | | | |
|---|---|---|---|
| 0622686 | 10/1962 | Belgium | 184/3.1 |
| 1244228 | 7/1967 | Fed. Rep. of Germany | 238/338 |

*Primary Examiner*—Ira S. Lazarus
*Assistant Examiner*—Alan B. Cariaso
*Attorney, Agent, or Firm*—Kirkpatrick & Lockhart

[57] ABSTRACT

A rail lubrication apparatus of the type used with a rail having a base with outwardly extending flanges, a head, and a web connecting the base and the head, is comprised of a wiping bar and a first set of clamps for maintaining the wiping bar in position with respect to the rail. The lubrication apparatus also comprises a pump actuator and a second set of clamps for maintaining the pump actuator in position with the rail. The rail lubrication apparatus may be used with a pump, responsive to the pump actuator, for pumping a lubricant from a reservoir to the wiping bar to form a complete rail lubrication system. The clamps, wiping bar, and pump actuator are each of a unique construction.

2 Claims, 6 Drawing Sheets

200
202
210
206
204
204
204
244
SWITCH
220
208
SUPPLY CONDITIONING & PROTECTION
214
230
218
216
226
224
228
222
234
232
236
238
VARIABLE TRANSFORMER
240
212
242
FROM POWER SOURCE
TO CONTROL CIRCUITRY

RAIL LUBRICATION APPARATUS

This is a continuation of copending application Ser. No. 07/687,360 filed on Apr. 18, 1991 now abandoned.

BACKGROUND OF THE INVENTION

1. Field of the Invention

The present invention relates to apparatus for lubricating rails and wheel flanges on a railroad and to apparatus for rigidly securing such lubricators and portions of them to railroad rails.

2. Description of the Invention Background

In the operation of railroads, it has long been the practice to apply grease or similar gel-like lubricants to the sides of the rail at curves, turn-outs, switches and, in some cases, to the sections of track immediately before a switch. Such lubricants have been and still are applied to the inside sides of the rail head at these locations to reduce the friction which naturally occurs as a train's wheels, particularly the wheel flanges, contact the sides of the rail. The resulting reduction in friction reduces wear on both the rail itself and the wheel flanges and contributes to reduced fuel consumption in the locomotion of the train. When such lubricant is dispensed on the rail immediately preceding a switch, the movement of the train tends to move the lubricant into the area of the switch so as to reduce the friction on the rail sections and wheel flanges as the train passes over the switch.

In furtherance of this practice, there have been many designs of lubricators and apparatus for securing them so as to permit the automatic application of a lubricant to the rail by reason of the train's passing. In some of these devices, it is the depression of the roadbed that triggers the dispensation of lubricant; in others, it is the tripping of a mechanical device, such as a lever or a plunger, by the train's wheels which activates a lubricant dispensing mechanism. Examples of such prior art devices are shown in U.S. Pat. Nos. 2,884,093; 2,518,786; 2,231,394 and 2,223,714.

Common to these devices is the need for means to rigidly secure the device either to the rails or to the track roadbed so that lubricant can be dispensed repeatedly at the desired rate and at the needed location. In most cases, such means involve a mechanical connection to the rail itself, such as by bolting or clamping in various ways. Examples of such connection means are shown in U.S. Pat. Nos. 3,147,822 and 2,168,554.

The problems associated with these prior art devices are many. Among other things, these prior art devices are often mechanically complex and difficult to install in the field. As a result, they are also often difficult to maintain and, due to the complexity of their design features, they tend to loosen and then become less effective as they are subjected to vibrations and rail roadbed flexion from traffic and contraction/expansion of the rail from thermal stress. Further, none of the prior art devices can easily accommodate different rail sizes. In effect, these devices either need to be manufactured in different sizes to accommodate each rail size or they need to be adapted to different rail sizes through various shim arrangements or adjustment bolts. These features only add to the tendency of the prior art devices to loosen and become less effective as they are used. Finally, these devices are difficult or impossible to adjust for the effects of wear on the head and face (or side) of the rail.

SUMMARY OF THE INVENTION

The present invention, in its broadest aspect, is directed to a rail lubricating system of the type used with a rail having a base with outwardly extending flanges, a head, and a web connecting the base and the head. The rail lubricating system is comprised of a wiping bar and a first set of clamps for maintaining the wiping bar in position with respect to the rail. The lubricating system also comprises a pump actuator and a second set of clamps for maintaining the pump actuator in position with respect to the rail. A pump is responsive to the pump actuator for pumping a lubricant from a reservoir to the wiping bar. Certain components of the rail lubricating system such as the clamps, wiping bar, and pump actuator are unique, and each represents an advance over the art.

The clamps of the present invention may be used for maintaining a device, such as a wiping bar or pump actuator, in position with respect to a rail. The clamp is comprised of a base section having first and second oppositely positioned ends. A hook extends from the first end of the base section and is sized to receive a rail base flange. A projection extends upwardly from the second end of the base section so as to not contact the rail base flange. The projection has a threaded bore therethrough for receiving a hold-down screw. The bore and the projection cooperate to orient the hold-down screw, preferably at an angle, whereby upon the screw's contact with the device, a force and counter-force are developed that hold both the device and the clamp in position with respect to the rail.

The wiping bar of the present invention may be used with a rail lubricating apparatus. The wiping bar is comprised of a manifold body having a plurality of channels formed therein. Each channel has a common beginning point and a unique end point. All of the channels are of substantially equal length. A manifold port plate is connected to the manifold body so as to cover the channels. The manifold port plate has an opening coinciding with the common beginning point of each of the channels and a plurality of apertures, each aperture coinciding with one of the unique end points.

A front blade is connected to the manifold port plate. The front blade has an opening coinciding with the opening of the manifold port plate and a plurality of apertures, which may take the form of slots, coinciding with the apertures of the manifold port plate. A distribution blade has an opening coinciding with the opening of the front blade and a plurality of channels. One channel coincides with each of the apertures of the front blade. The channels extend upwardly to a top edge of the distribution blade whereby a path for a lubricant is provided through the channels of the manifold body, the apertures of the manifold port plate, the apertures of the front blade, and the channels of the distribution blade.

The front blade and distribution blade additionally have a plurality of slotted fastening apertures through which may pass a plurality of fasteners used to hold together the components of the wiping bar, i.e., the manifold body, manifold port plate, front blade, distribution blade, and a back bar. Those slotted fastening apertures allow the front and distribution blades to be adjusted vertically to permit optimum positioning with respect to the rail head. In the preferred embodiment, the front blade and distribution blade are locked together by an interlocking tab so they can move together vertically. Further, the top of the front blade is somewhat lower than the top of the distribution blade to foster distribution of lubricant toward the side of the rail head. Finally, a back bar is connected to the distribution blade to function as both a stiffener and as a trough to catch excess lubricant.

A lubricant inlet port extends through the openings in the distribution blade and the front blade. The inlet port is connected to the opening in the manifold port plate to provide the lubricant to the common beginning point of the channels in the manifold body.

A first pair of brackets is connected to the manifold body to provide a bearing surface, preferably extending at an angle, which cooperates with the hold-down screw of the clamp to maintain the wiping bar in position with respect to the rail. The brackets are provided with rounded heads for contacting the underside of the railhead. Finally, a second pair of brackets carrying elevation screws is connected to the manifold body for positioning the wiping bar to accommodate the rail size to which the wiping bar is being secured.

The pump actuator of the present invention may be used with a rail lubricating apparatus. The pump actuator comprises a master cylinder having a plunger extending therefrom and an output port. A frame member carries the master cylinder. The frame member has a vertical face for contacting the side of a head of a rail. A first pair of brackets is connected to the frame member. Each of the brackets has a bearing surface, preferably extending at an angle, which cooperates with a hold-down screw of a clamp to maintain the pump actuator in position with respect to the rail. The frame member is provided with threaded holes therethrough carrying adjustment screws. The frame member also carries a second pair of brackets carrying elevation screws such that rails of varying size can be accommodated. The adjustment screws and elevation screws can be used to position the vertical surface parallel with the side of the railhead and the plunger extending above the top of the railhead.

The clamp of the present invention may be constructed so as to be a single piece. Such a clamp may be easily connected to a rail in the field. Upon rotation of the hold-down screw until the hold-down screw firmly contacts the bearing surface of the device to be clamped, a force or moment is developed which holds the device firmly in position with respect to the rail. The unique one-piece construction, ease of installation in the field, and generation of a constant, firm force for holding the device in position represents an advance over the art.

With respect to the wiping bar, the channels formed in the manifold body are of equal length such that the lubricant is uniformly distributed. Additionally, removal of the manifold port plate exposes the channels thereby providing for easy cleaning, maintenance and repair. Finally, the second pair of brackets for positioning the wiping bar provides two pairs of contact points between the wiping bar and the rail. Each pair is comprised of one contact point located under the head of the rail and another contact point located on the top of one of the rail base flanges. By manipulation of those contact points, the wiping bar can accommodate a wide range of rail sizes. Once adjusted to accommodate the rail size involved, the distribution blade can be precisely positioned with respect to the railhead by elevating it with respect to the manifold body by reason of the slotted fastening apertures provided in the front blade and the distribution blade. The first pair of brackets provides the bearing surfaces which cooperate with the hold-down screws of a clamp of the type previously described. Thus, once the hold-down screws are tightened, the position of the wiping bar remains fixed with respect to the rail.

The pump actuator of the present invention is comprised of a unique frame member. The adjustment screws and elevation screws carried by the frame member can be used to adjust the height and angle of the vertical face and plunger with respect to the railhead. Through manipulation of those screws, the vertical face and plunger can be precisely positioned with respect to the railhead. Thereafter, the bearing surfaces provided by the first brackets cooperate with the hold-down screws of the clamp previously described. In that manner, the pump actuator, and hence the plunger, are maintained in the desired position.

It is an object of the present invention to provide a rail lubrication apparatus and clamp for securing it to a rail which is easily installed in the field, is not mechanically complex, has few moving parts, is easily adaptable to multiple rail sizes, and is easily adjustable to accommodate worn rails. It is a further object to the present invention to provide a clamp for securing devices to a rail, such as the component parts of a rail lubrication apparatus, which will remain tight and secure under extreme traffic and track conditions. It is likewise an object of the present invention to provide such a clamp which does not interfere with current rail retaining devices, such as rail anchors and clips, and which require minimal clearance under the rail to install. Those and other objects and benefits of the present invention are illustrated in the Description of a Preferred Embodiment set forth below.

BRIEF DESCRIPTION OF THE DRAWINGS

For the present invention to be easily understood and readily practiced, a preferred embodiment will now be described, by way of example only, with reference to the accompanying FIGURES, wherein.

DETAILED DESCRIPTION OF A PREFERRED EMBODIMENT

Figure 1:
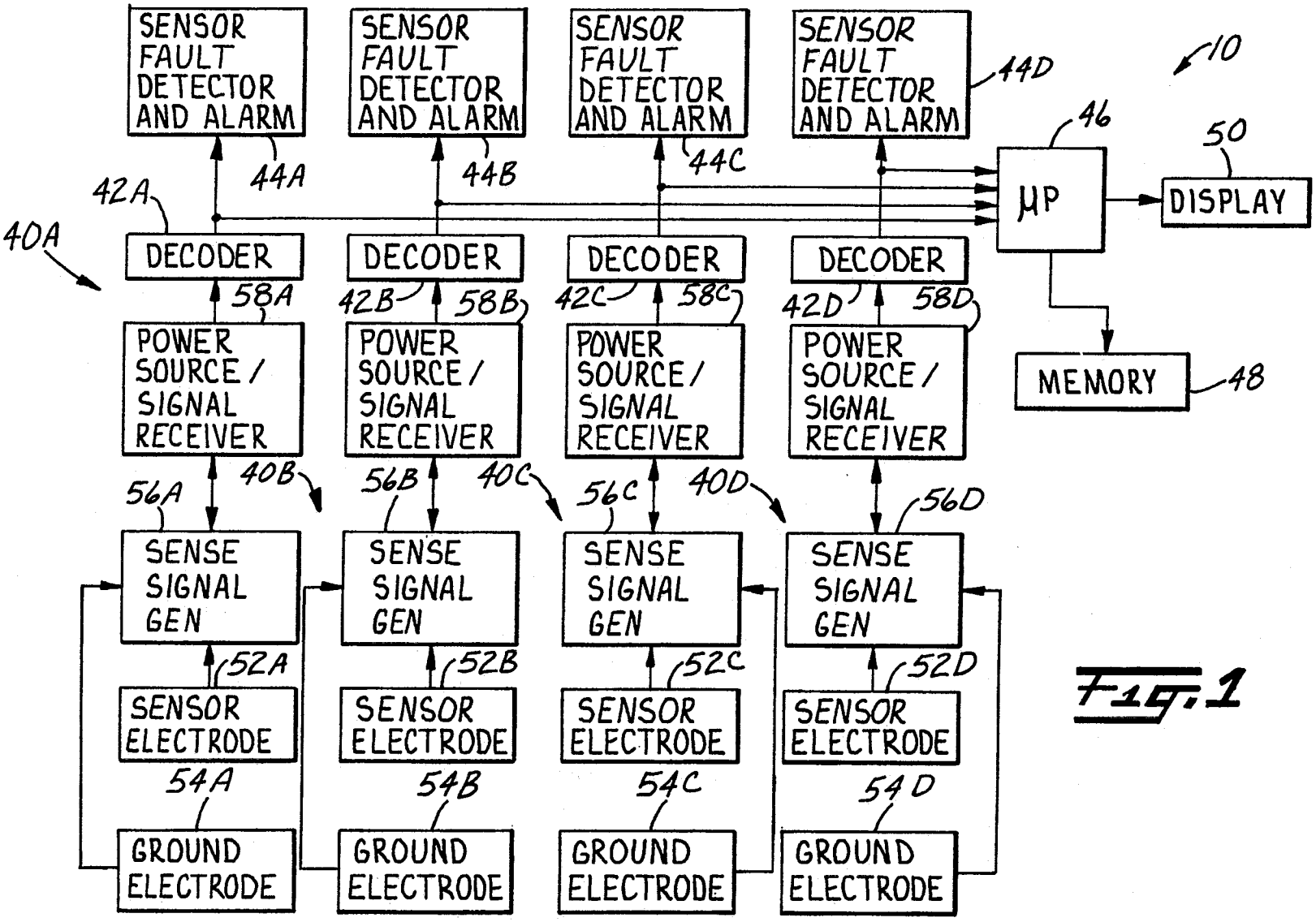
FIGS. 1 and 2 illustrate a lubricating system constructed according to the teachings of the present invention with FIG. 1 primarily illustrating a side view of a pump actuator held in position on a rail by a clamp and FIG. 2 illustrating a side view of a wiping bar held in position on a rail by a clamp.
Figure 2:
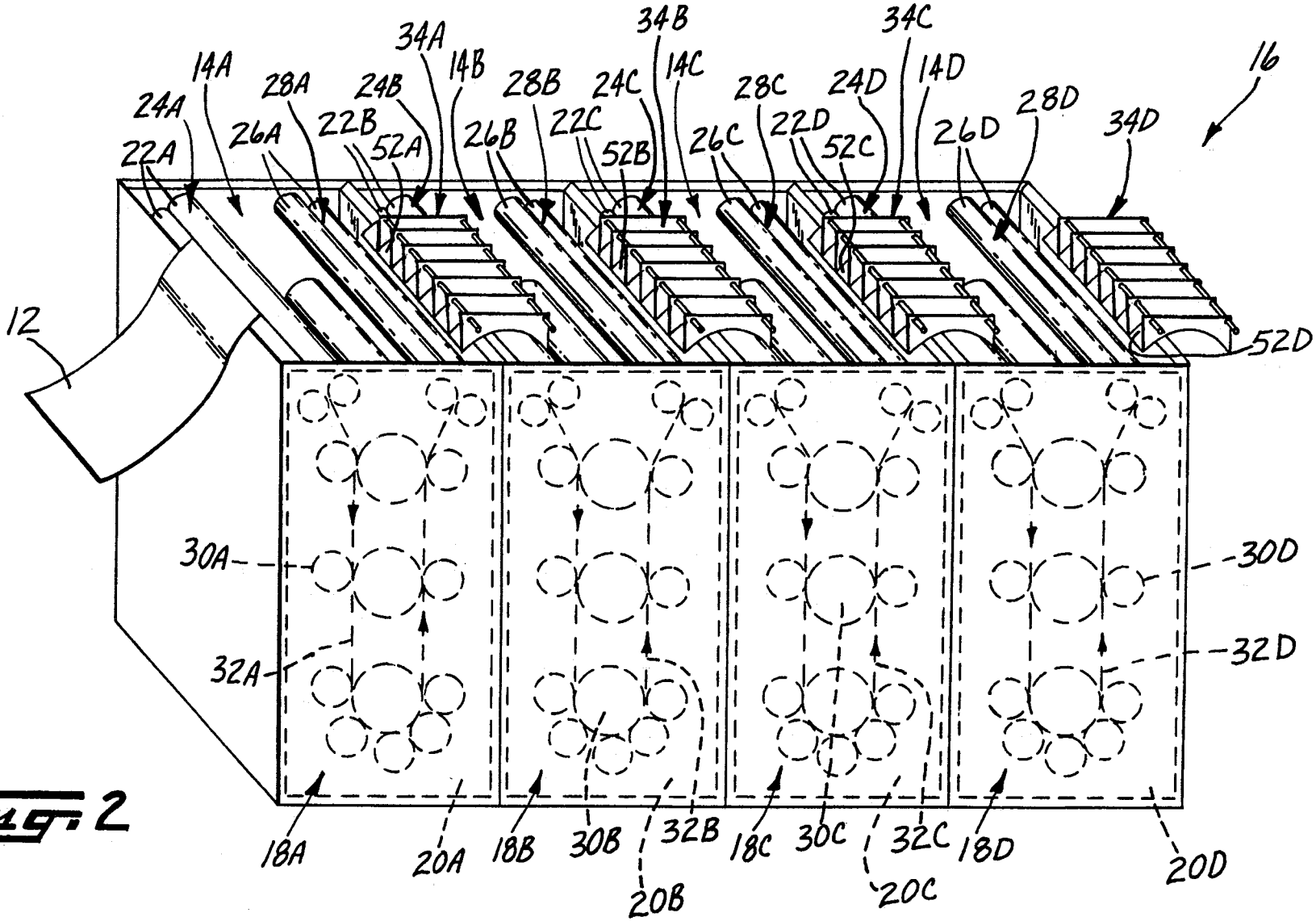

Turning to FIGS. 1 and 2, a railway rail lubrication apparatus and system constructed according to the teachings of the present invention is intended to be used with railway rails 10. The rail 10 is of the type having a base 12 with outwardly extending flanges 14 and 16. The rail 10 has a head 18 which is connected to the base 12 by a web 20.

The rail lubrication apparatus of the present invention is comprised of a pump actuator 22, seen in FIG. 1, a pair of clamps 24, one of which is seen in FIG. 1, for holding the pump actuator 22 in position with respect to the rail 10, a wiping bar 26, seen in FIG. 2, and a pair of clamps 28, one of which is seen in FIG. 2, for holding the wiping bar 26 in position with respect to the rail 10. The pump actuator 22 has an output port 30, seen in FIG. 7, and the wiping bar 26 has a lubricant inlet port 32 seen in FIG. 4. By virtue of the outlet port 30 and the lubricant inlet port 32, the pump actuator 22 and wiping bar 26, respectively, may be connected to a pump 34 for pumping a lubricant from a reservoir 38 to form a rail lubrication system. Rail lubrication systems are known in the art and will therefore only be briefly described here.

It is desirable to provide lubrication to the area 118 of the railhead 18 on which railway wheel flanges ride. That desire may be due to curves, switches, or any other location where friction and excessive wear is a problem. The wiping bar 26 is appropriately positioned as shown in FIG. 2 to provide a lubricant to the area 118 of the railhead 18.

To facilitate application of the lubricant, the pump actuator 22 is positioned so that a plunger 36 carried thereby extends above the railhead 18. The pump actuator 22 is located on the side of the railhead 18 which is opposite of the side where the wheel flanges ride. When a railway wheel contacts plunger 36, plunger 36 is depressed thereby hydraulically actuating the pump 34, which may be any one of various well-known types of such pumps. Pump 34 pumps lubricant from the reservoir 38 to the wiping head 26 for application to the railhead. In that manner, application of the lubricant is effected when needed.

One aspect of the present invention is the pairs of clamps 24 and 28. The reader will understand that the clamps 24 and 28 are identical in construction and operation. In FIG. 1, the clamp 24 is illustrated as having a base section 40. The base section 40 has a first end 42 and a second end 44. Extending from the first end 42 is a hook 46 sized to receive the rail base flange 14. A projection 48 extends upwardly from the second end 44 at an angle (which may be ninety degrees) so as to not contact the rail base flange 16. As can be seen from the FIGURES, the base section 40 of the clamp 24 is sufficiently long to enable the hook 46 to clear flange 14 during installation and, after installation, for the projection 48 to completely clear the flange 16. More specifically, the rigid projection 48 is displaced along the base section 40 a sufficient distance from the hook 46 to be slid under rail 10 and to engage the rail base flange 14 on the side of the rail opposite of the side on which the projection 48 is positioned. Providing a base section 40 of sufficient length is thus desirable to enable the clamp 24 to be easily attached in the field.

The projection 48 has a pair of threaded bores 50 and 52 extending therethrough. The two threaded bores 50 and 52 are provided to accommodate rails 10 having webs 20 of different sizes, although normally only one bore will be used. As shown in FIG. 1, the threaded bore 50 carries a hold-down screw 54. The projection 48 and the threaded bore 50 cooperate in such a manner that the hold-down screw 54 preferably projects from projection 48 at a predetermined angle. That angle may be, for example, a downwardly extending angle of about twenty-five degrees. Those of ordinary skill in the art will recognize that the desired angle can be achieved by the angle the projection 48 makes with the base section 40, the angle of the threaded bores 50 and 52, or some combination thereof. The purpose of the angle is to enable, upon tightening of hold-down screw 54 into contact with a device such as the pump actuator 22, the generation of a force or a moment to firmly hold the device in position with respect to the railhead and to generate an opposite force or moment tending to urge the clamp 24 in a clockwise direction as seen in FIG. 1. That moment keeps hook 46 firmly engaged with base flange 14 and keeps base section 40 in firm engagement with the rail base 12. Finally, a jam nut 56 may be provided so that the hold-down screw 54 remains in the desired position.

As seen from FIGS. 1 and 2, the clamps 24 and 28 may be comprised of a single piece. By virtue of their construction, they may be easily connected to a rail 10 in the field. Additionally, upon tightening of the hold-down screws 54, the clamps 24 and 28 provide a constant and firm force for maintaining the device in position with respect to the rail 10 and the clamps firmly attached to the rail.

Figure 7:
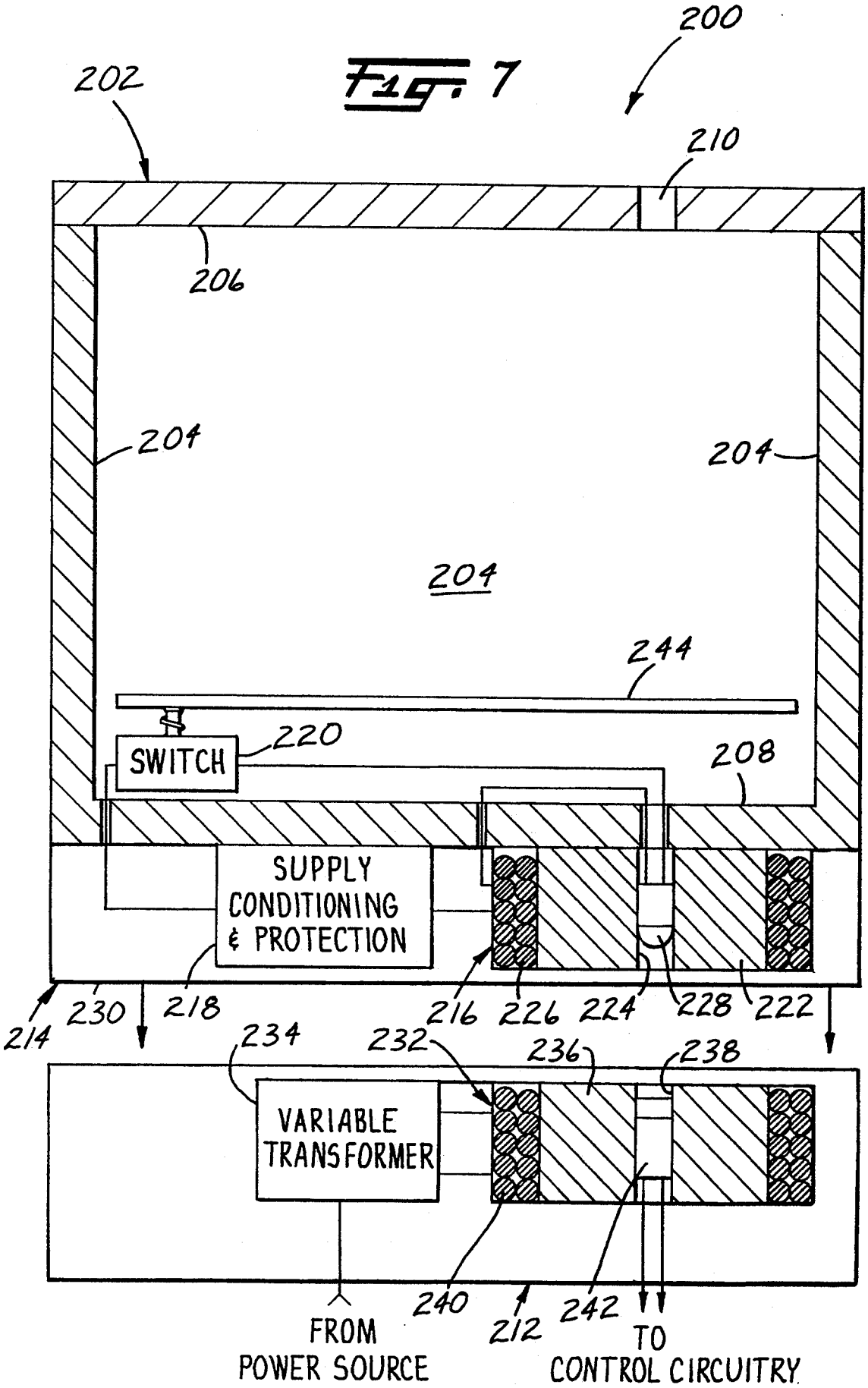
FIG. 7 is a plan view of the pump actuator held in position on a rail by a pair of clamps.
Figure 1:
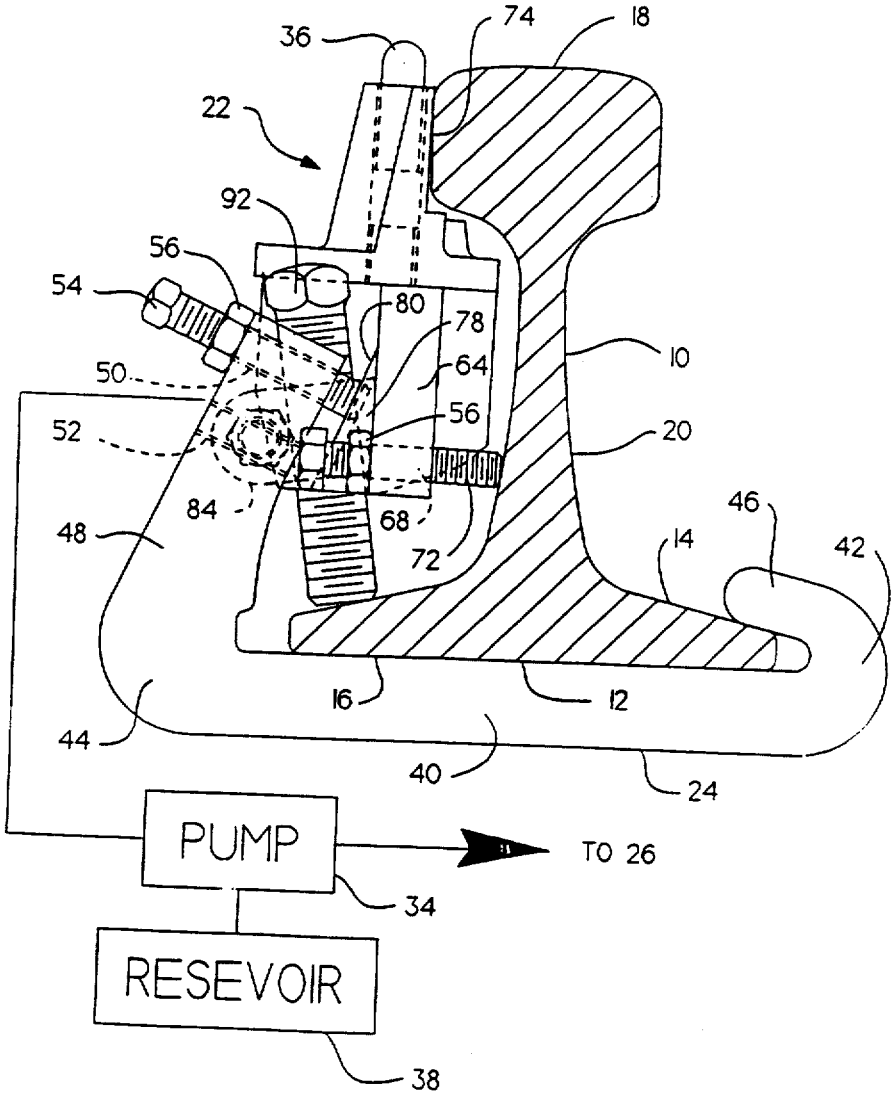
Figure 2:
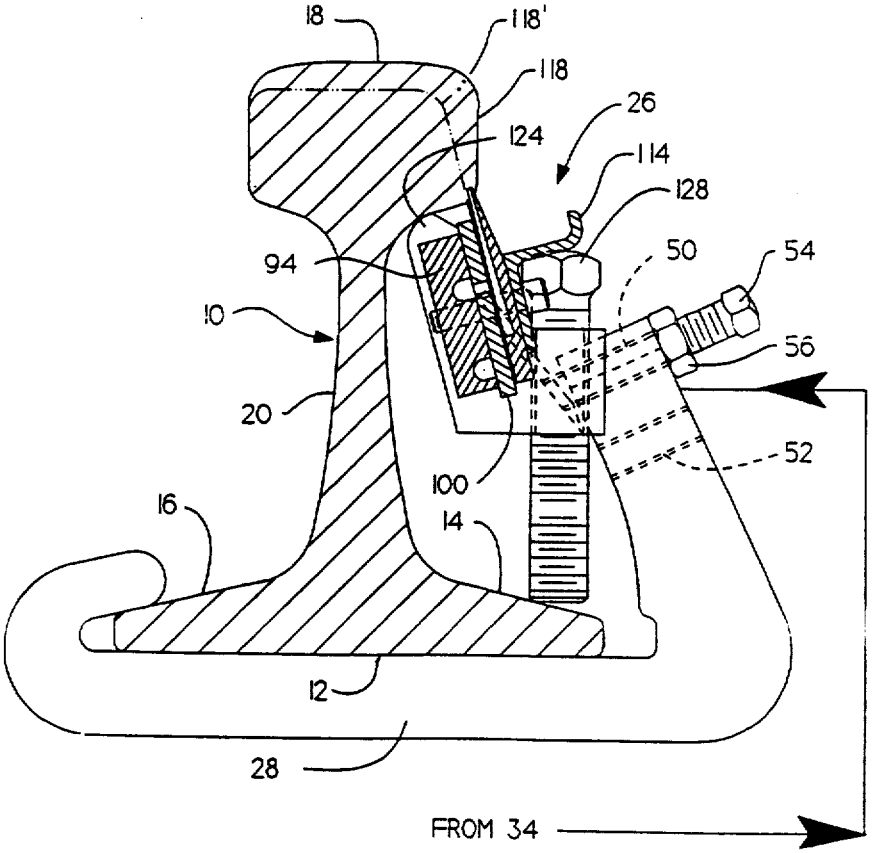
Figure 3:
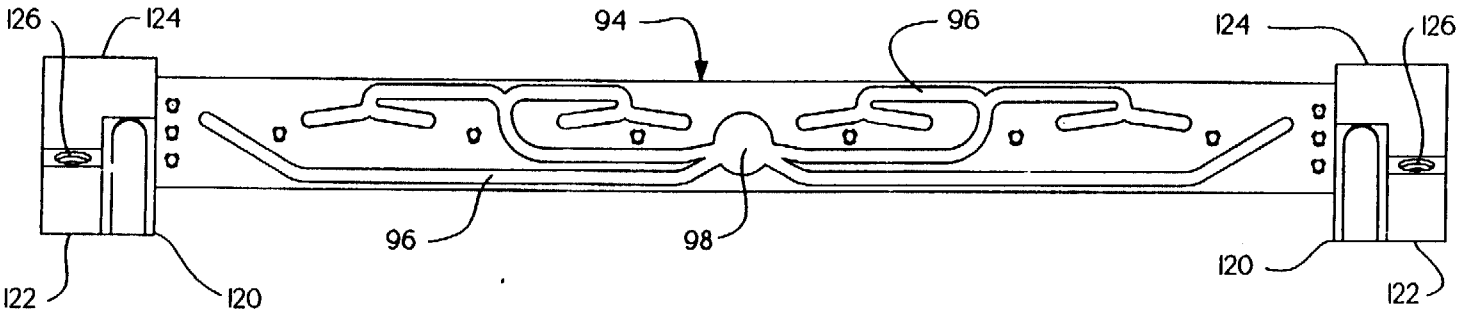
Figure 4:
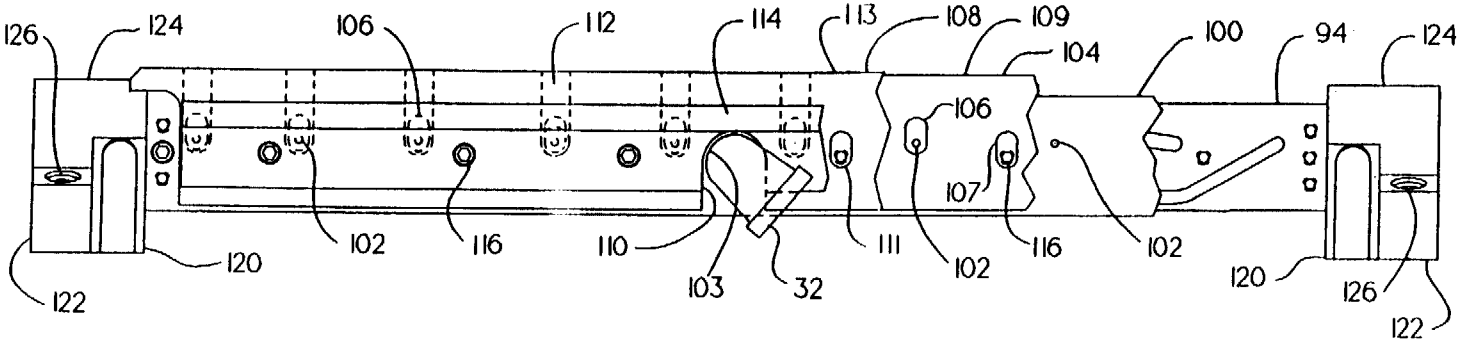
Figure 5:
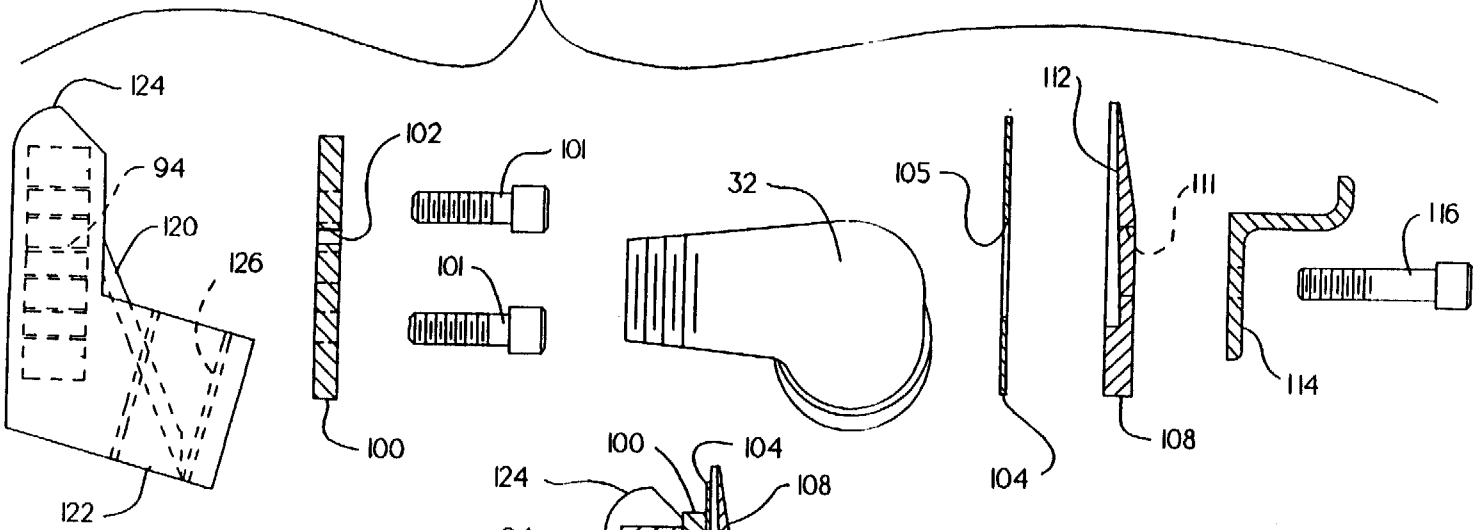
Figure 6:
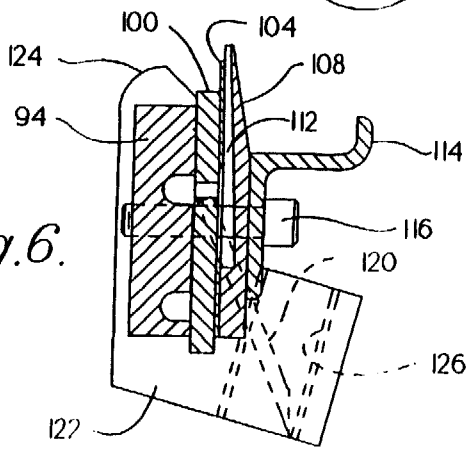
Figure 7:
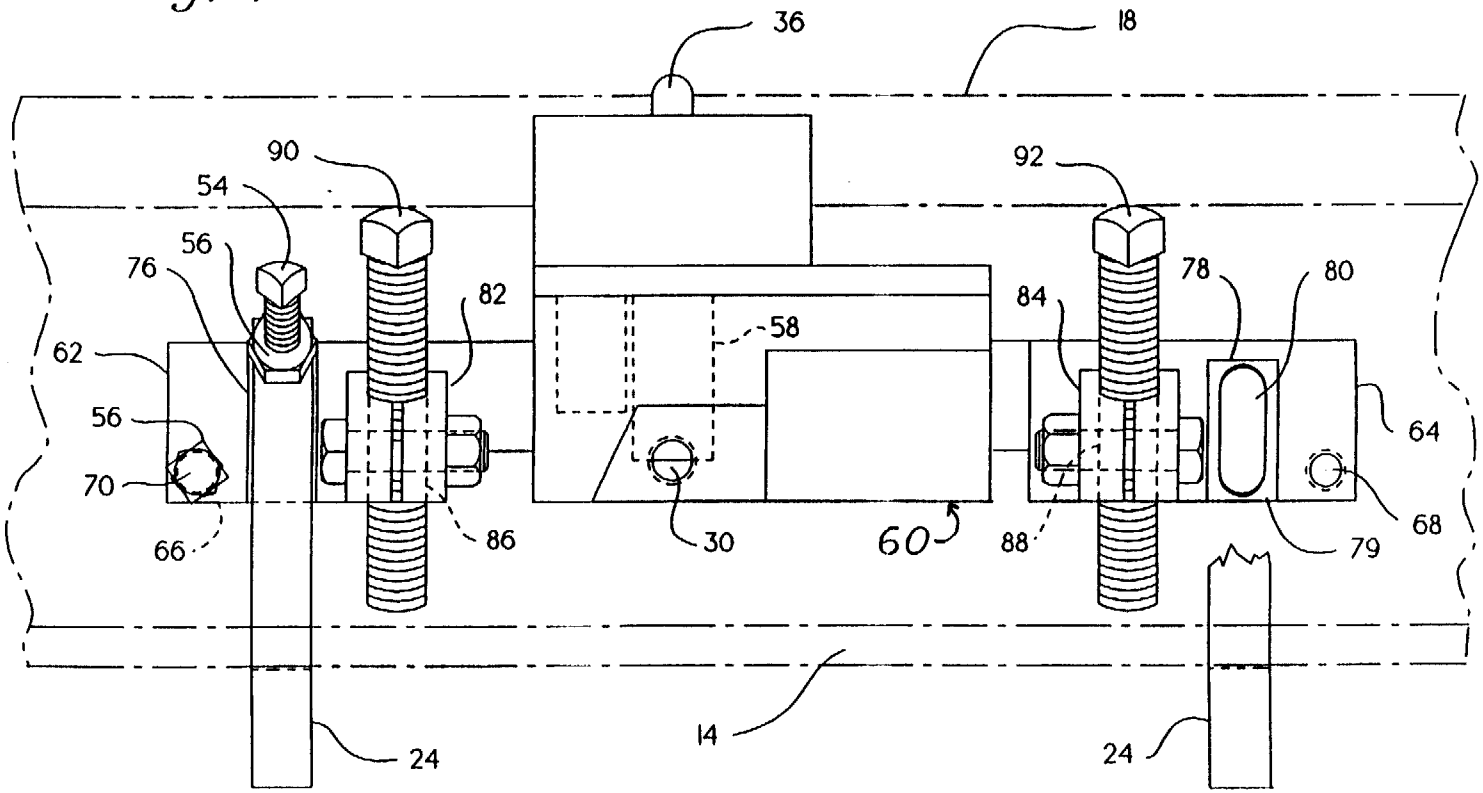

The pump actuator 22 will now be described in conjunction with FIGS. 1 and 7. The pump actuator 22 is comprised of a master cylinder 58 having the plunger 36 and the output port 30. The master cylinder 58 is carried by a frame member 60. The frame member 60 has two wing-like projections 62 and 64, seen best in FIG. 7. Each wing-like projection 62 and 64 has a threaded hole 66 and 68, respectively, extending horizontally therethrough. The threaded holes 66 and 68 carry threaded adjustment screws 70 and 72, respectively. The adjustment screws 70 and 72 may be provided with jam nuts 56. The frame member 60 has a vertical face 74 formed therein for contacting the side of the head 18 of the rail 10.

Each of the wing-like projections 62 and 64 carries one of a first pair of brackets 76 and 78, respectively. The first pair of brackets 76 and 78 have a horizontal portion and a vertical portion. The vertical portion of the brackets 76 and 78 is connected to the wing-like projections 62 and 64, respectively. The brackets 76 and 78 are triangular in shape with the third side of the bracket forming an angled surface 79 which acts as a bearing surface for a hold-down screw. The hold-down screw may be the hold-down screw 54 of the clamp 24 previously discussed. Each of the angled surfaces 79 may have a groove 80 formed therein. The purpose of the groove 80 is to provide sidewalls for retaining the end of the hold-down screw 54. The interaction of the hold-down screw 54 with the angled surfaces 79 of the first pair of brackets 76 and 78 is described in greater detail hereinbelow.

Completing the description of the pump actuator 22, each of the wing-like projections 62 and 64 carries one of a second set of brackets 82 and 84, respectively. Each of the brackets 82 and 84 has a substantially horizontal portion and a vertical portion. Each bracket 82 and 84 is connected along its vertical portion to the wing-like members 62 and 64, respectively. The horizontal portions of each of the brackets 82 and 84 have threaded apertures 86 and 88 therethrough, respectively. Each of the threaded apertures 86 and 88 carries an elevation screw 90 and 92, respectively. The elevation screws 90 and 92 are of sufficient length to facilitate contact with the rail base flange 16 when the vertical face 74 is engaging the vertical side of the head 18 of the rail 10. The order along the wing-like projections 62 and 64 of the holes 66 and 68, first brackets 76 and 78, and second brackets 82 and 84, respectively, is not critical. Thus, the second brackets 82 and 84 could be outboard of first brackets 76 and 78, respectively, as well as any other orientation of those components.

The adjustment screws 70 and 72, cooperating with threaded holes 66 and 68, respectively, and the elevation screws 90 and 92, cooperating with threaded apertures 86 and 88, respectively, constitute a means carried by the frame member 60 for positioning the vertical face 74 and plunger 36 with respect to the railhead 18. As can be seen, adjustment of the elevation screws 90 and 92 raises vertical face 74 and plunger 36 to the correct height for contacting the side of railhead 18. Adjustment of adjustment screws 70 and 72 varies the angle of the vertical face 74 and plunger 36 with respect to the railhead 18 so as to make vertical face 74 parallel to the side of railhead 18. By appropriate adjustment of adjustment screws 70 and 72 and elevation screws 90 and 92, the vertical face 74 and plunger 36 can be precisely positioned with respect to the railhead 18.

After proper positioning of the vertical face 74 and plunger 36 is completed, the hold-down screws 54 of the clamps 24 are tightened to bring the hold-down screws 54 into engagement with the angled surfaces 79 of brackets 76 and 78. As can be seen from FIG. 1, the force exerted by the hold-down screws 54 upon the angled surfaces 79 of brackets 76 and 78 generates a force which urges the pump actuator 22 into engagement with the rail 10. By virtue of that force, the clamps 24 maintain the pump actuator 22 in the desired position with respect to rail 10. Thus, the vertical face 74 and plunger 36 are held in the proper position at all times. The counter force generated urges the clamp 24 in a clockwise direction thereby maintaining constant and firm contact between hook 46 and flange 14 and between base section 40 and rail base 12.

Figure 3:
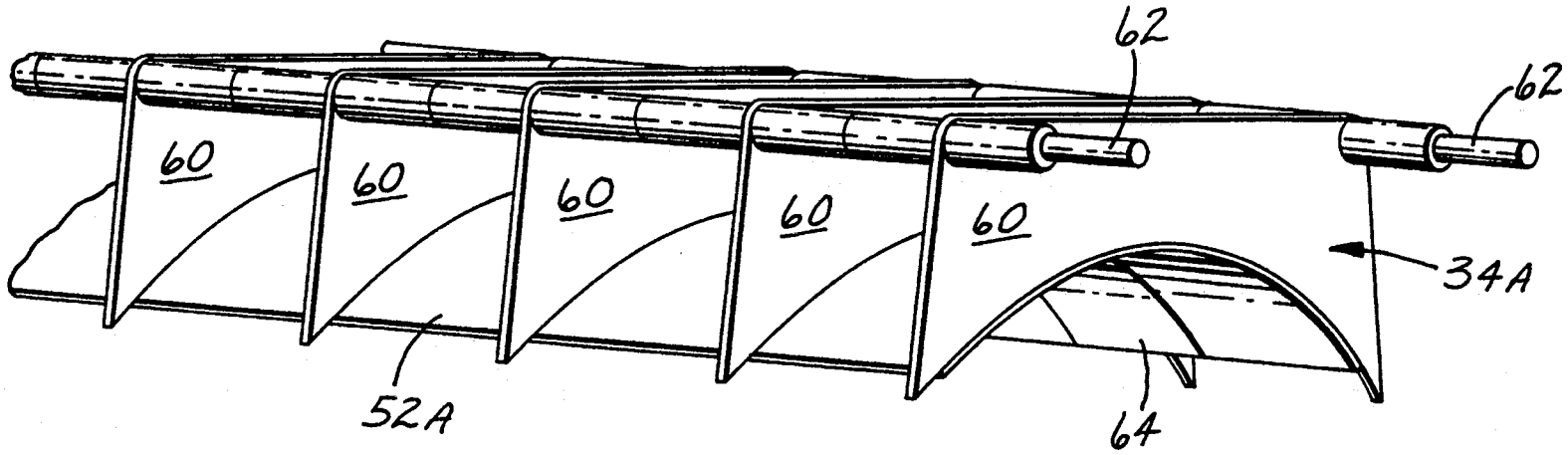
FIG. 3 is a plan view of the manifold body of the wiping bar.

The wiping bar 26 of the present invention will now be described in conjunction with FIGS. 2, 3, 4, 5, and 6. In FIG. 3, a manifold body 94 is illustrated. The manifold body 94 has a plurality of channels 96 milled, cast, or otherwise formed therein. The channels 96, share a common beginning point 98 although each channel 96 has a unique end point. As can be seen from FIG. 3, the length of each of the channels 96 from the common beginning point 98 to that channel's unique end point is substantially the same amongst all channels. That feature enables lubricant to be uniformly output from each of the channels 96.

A manifold port plate 100, seen in FIGS. 2, 4, 5, and 6, is connected to the manifold body 94 by screws 101 to cover the channels 96. The manifold port plate 100 has an opening 103, seen in FIG. 4, which coincides with the common beginning point 98 of each of the channels 96. The manifold port plate 100 also has a plurality of apertures 102, each coinciding with the unique end point of one of the channels 96.

A front blade 104 is connected to the manifold port plate 100 by screws 116 extending through slotted fastening apertures 107. The front blade 104 has an opening 105 coinciding with the opening 103 of the manifold port plate 100. The front blade 104 also has a plurality of slotted apertures 106 coinciding with the apertures 102 of the manifold port plate 100.

Figure 4:
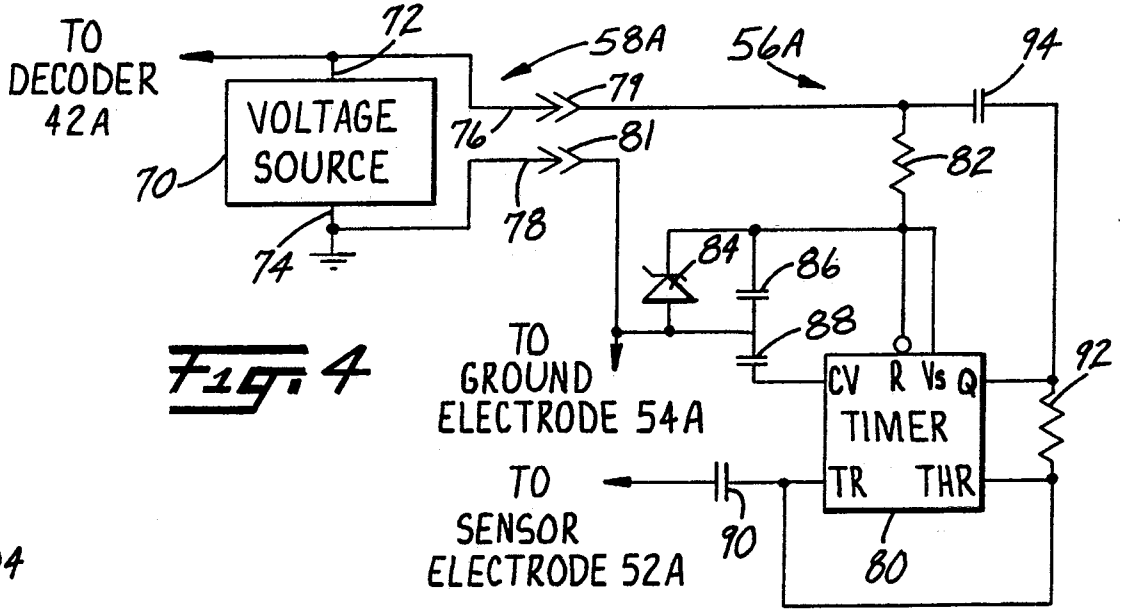
FIG. 4 is a plan view of the wiping bar with parts broken away.
Figure 5:
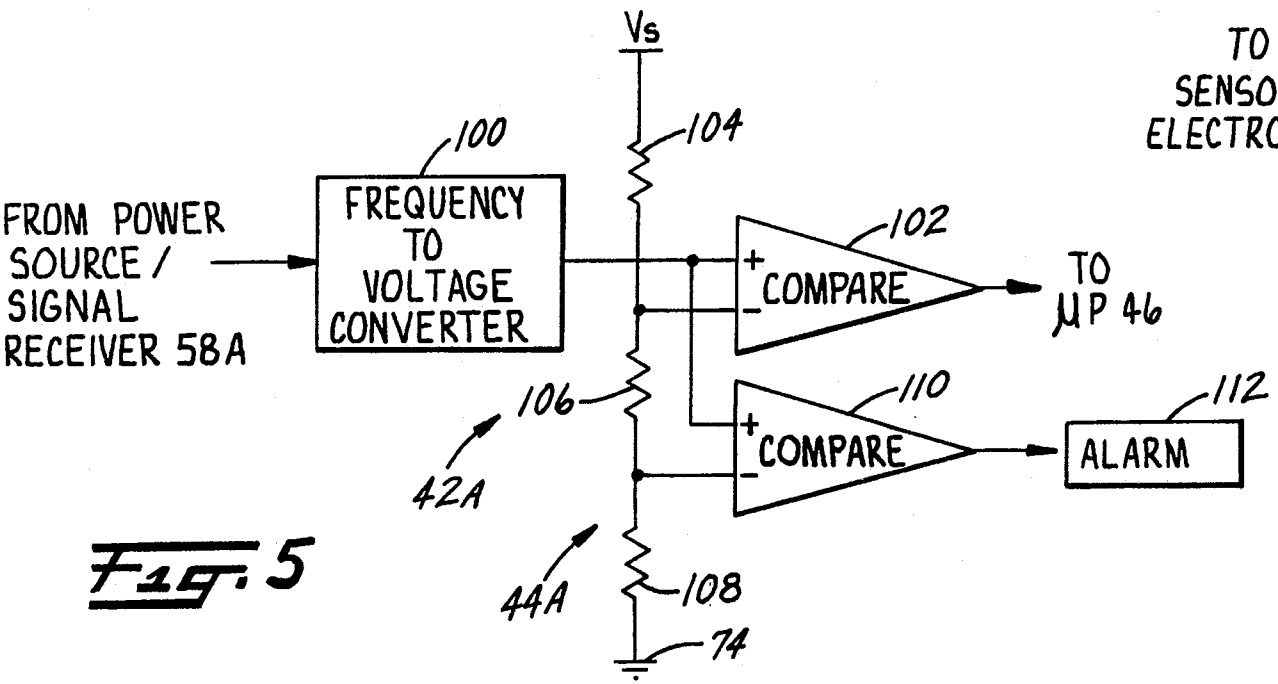
FIG. 5 is an exploded view illustrating the assembly of the components comprising the wiping bar.
Figure 6:
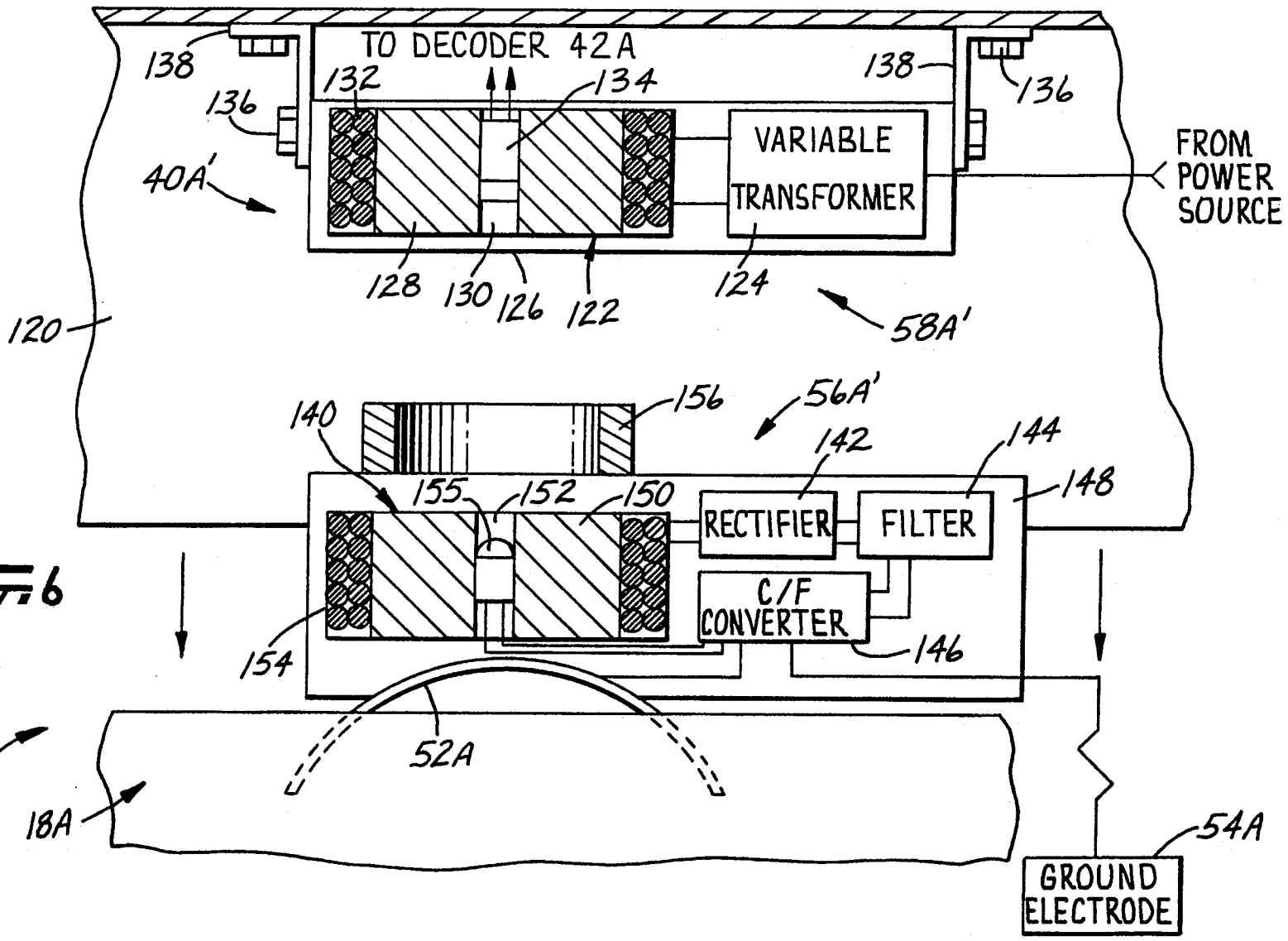
FIG. 6 is a cross-sectional view illustrating the components of FIG. 5 as they appear when assembled.

A distribution blade 108 is connected to the front blade 104 by screws 116. The distribution blade 108 has an opening 110 coinciding with the opening 105 of the front blade 104. The distribution blade 108 has a plurality of channels 112. Each one of the channels 112 coincides with one of the slotted apertures 106 of the front blade 104 and a plurality of slotted fastening apertures 111 for receiving screws 116. As seen in FIG. 4, each of the channels 112 extends upwardly to a top edge 113 of the distribution blade 108. A back bar 114 is connected to the distribution blade 108 to provide support and to act as a catch for any overflow of lubricant or grease. The screws 116 may be used to connect the front blade 104, distribution blade 108, and back bar 114 together and with the manifold body 94 and manifold port plate 100.

The lubricant inlet port 32 extends through the opening 110 in the distribution blade 108 and the opening 105 in the front blade 104 and is connected to the opening 103 in the manifold port plate 100 which coincides with the common beginning point 98. In that manner, a path for the lubricant is provided through inlet port 32, through each channel 96 from the common beginning point 98 to each channel's unique end point, through the apertures 102 in the manifold port plate 100, through the slotted apertures 106 in the front blade 104, through the channels 112 in the distribution blade 108 to the top 113 of the distribution blade 108 and thence on to the face 118 of railhead 18.

Because the front blade 104 has slotted apertures 106 and slotted fastening apertures 107 and because of the construction of channels 112 and the slotted fastening apertures 111 of the distribution blade 108, the front blade 104 and distribution blade 108 may be moved, in unison, in a vertical direction with respect to the manifold body 94, manifold plate 110, and back bar 114. That enables precise adjustment of the blades 104 and 108. A tab and slot arrangement, pin and hole arrangement, (not shown) or some other similar mechanical device, may be carried by the front blade 104 and distribution blade 108 to ensure that these blades move in unison. Finally, a top edge 109 of the front blade 104 does not extend as high as the top edge 113 of distribution blade 108. That tends to urge the lubricant toward the rail face 118.

The wiping bar 26 carries a first pair of brackets 120. The first pair of brackets 120 is constructed in a manner similar to the first pair of brackets 76 and 78 of the pump actuator 22. Because the construction and operation of the first pair of brackets 120 of the wiping bar 26 is identical to the construction and operation of the first pair of brackets 76 and 78 previously discussed, that discussion will not be repeated here.

The wiping bar 26 also carries means for positioning to accommodate different rail sizes and to peri, it orientation of the distribution blade 108 with respect to the face 118 of railhead 18. That means is comprised of a second pair of brackets 122. The second pair of brackets 122 is constructed so as to have a substantially horizontal portion and a vertical portion. Each bracket 122 is connected along its vertical portion to either the first brackets 120 or the manifold body 94, depending upon which pair of brackets is the outboard pair. The vertical portion of the bracket 122 has a head 124 which extends above the manifold body 94. The head 124 is designed for engaging the underside of the head 18 of the rail 10 as shown in FIG. 2. The substantially horizontal portion of the brackets 122 has a threaded aperture 126. The threaded aperture 126 is adapted to receive an elevation screw 128. The elevation screws 128 are of sufficient length to facilitate contact with the rail base flange 14 when the heads 124 are engaging the underside of the head 18 of rail 10.

In operation, the wiping bar 26 is positioned with respect to the rail 10 as shown in FIG. 2. The heads 124 provide two contact points with the underside of the railhead 18 while the elevation screws 128 provide an additional two contacts with the rail base flange 14. By virtue of the elevation screws, the wiping bar 26 can accommodate rails of varying size. The wiping bar 26 may be positioned as shown in FIG. 2 so that the distribution blade 108 is tangent to a worn rail face 118' or the wiping bar 26 may be rotated slightly clockwise so that the distribution blade 108 is tangent to the rail face 118. Thus, by manipulation of the elevation screws 128 to take into account the size of the web 20, and appropriate rotation, clockwise or counterclockwise, of the wiping bar 26, the wiping bar 26 is brought into the proper position with respect to the rail face 118 or 118'. Thereafter, the height of the front blade 104 and distribution blade 108 may be adjusted as previously discussed.

After the distribution bar 26 has been properly positioned, the hold-down screws 54 of the clamps 28 are tightened to bring them into engagement with the angled surfaces 79 of the first pair of brackets 120. The forces exerted by the hold-down screws 54 on the angled surfaces firmly and uniformly hold the wiping bar 26 in position and the clamp 28 in engagement with the rail 10 as previously discussed. In that manner, the wiping bar 26 is maintained in the proper position at all times.

As seen from the foregoing description, the rail lubricating apparatus of the present invention is comprised of a unique wiping bar 26, a unique pump actuator 22, and unique clamps 24 and 28 for holding the pump actuator 22 and wiping bar 26, respectively, in their proper positions. The railroad rail lubricating apparatus of the present invention may be used in conjunction with a pump 34, responsive to the pump actuator 22, for pumping the lubricant from the reservoir 38 to the wiping head 26 to form a rail lubricating system. The apparatus and system of the present invention provides a simple, inexpensive structure that is surprisingly effective in the harsh environments encountered along railways.

While the present invention has been described in conjunction with a preferred embodiment thereof, many modifications and variations will be apparent to those of ordinary skill in the art. This disclosure and the following claims are intended to cover all such modifications and variations.

What we claim is:

1. A clamp in combination with a wiping bar, said clamp for use in maintaining the wiping bar in position with respect to various sized rails of the type having a base with outwardly extending flanges and a web, said clamp comprising:

a rigid base section having first and second oppositely positioned ends;

a rigid hook extending from said first end of said base section and sized to receive any one of the plurality of variously sized rail based flanges;

a hold-down screw; and a rigid projection extending substantially vertically upwardly from said second end of said base section, said rigid projection being displaced along said base section a sufficient distance from said hook to enable said hook to be slid under a rail and to engage the rail base flange on the side of the rial opposite of the side on which said projection is positioned, said projection having a threaded bore therethrough for receiving said hold-down screw, said bore and said projection cooperating to orient said hold-down screw at an angle with respect to said base section whereby said hold-down screw extends downwardly toward the web such that said screw is oriented to contact the wiping bar and develop a force for holding the wiping bar in position with respect to the rial and a counterforce is developed for holding said hook in contact with the rail base flange and a moment is developed for holding said base section in contact with the underside of the rail, said projection, base section, and hook being integrally formed;

said wiping bar having:

a first pair of brackets, each of said brackets of said first pair of brackets having an angled surface acting as a bearing surface for said hold-down screw;

a second pair of brackets having a horizontal portion and a vertical portion, each of said second pair of said brackets being connected along its vertical portion to said wiping bar, said vertical portion of each of said second pair of said brackets having a head for engaging an underside of the head of the rail, said horizontal portion of each of said second pair of said brackets having a threaded aperture therethrough for receiving an elevation screw, a pair of elevation screws, one screw being positioned within each of said threaded apertures, said screws being of sufficient length to facilitate contact with the rail base flange when said heads are engaging the underside of the head of the rail, whereby upon engagement of said hold-down screws with said angled surfaces, said wiping bar is wedged firmly between the underside of the rail head and the rail base flange.

2. A clamp in combination with a pump actuator, said clamp for use in maintaining the pump actuator in position with respect to various sized rails of the type having a base with outwardly extending flange and a web, said clamp comprising;

a rigid base section having first and second oppositely positioned ends;

a rigid hook extending from said first end of said base section and sized to receive any one of the plurality of variously sized rail base flanges;

a hold-down screw; and a rigid projection extending substantially vertically upwardly from said second end of said base section, said rigid projection being displaced along said base section a sufficient distance from said hook to enable said hook to be slide under a rail and to engage the rail base flange on the side of the rail opposite of the side on which said projection is positioned, said projection having a threaded bore therethrough for receiving said hold-down screw, said bore and said projection cooperating to orient said hold-down screw at an angle with respect to said base section whereby said hold-down screw extends downwardly toward the web such that said screw is oriented to contact the pump actuator and develop a force for holding the pump actuator in position with respect to the rail and a counterforce is developed for holding said hook in contact with the rail base flange and a moment is developed for holding said base section in contact with the underside of the of the rail, said projection, base section, and hook being integrally formed;

said pump actuator having;

a first pair of brackets, each of said brackets of said first pair of brackets having an angled surface acting as a bearing surface for said hold-down screw;

a plurality of threaded holes extending horizontally through said pump actuator and a plurality of threaded adjustment screws, one screw positioned within each of said threaded holes;

a second pair of brackets having a horizontal portion and a vertical portion, each of said second pair of said brackets being connected along its vertical portion of said pump actuator, said horizontal portion of each of said second pair of said brackets having a threaded aperture therethrough for receiving an elevation screw;

a pair of elevation screws, one positioned within each of the threaded apertures, said screws being of sufficient length to facilitate contact with the rail base flange when a vertical face of said pump actuator is engaging a side of a head of the rail, whereby upon engagement of said hold-down screws with said angled surfaces, said pump actuator is held in position against the rail.

* * * * *

UNITED STATES PATENT AND TRADEMARK OFFICE

CERTIFICATE OF CORRECTION

PATENT NO. : 5,348,120

DATED : September 20, 1994

INVENTOR(S) : Ronald K. Junk, William T. Urmson, Jr. and Thomas R. Walker

It is certified that error appears in the above-indentified patent and that said Letters Patent is hereby corrected as shown below:

Delete the Title Page, showing the illustrative figure and substitute therefor the attached Title Page.

Delete the Figures appearing on sheets 1-6 and substitute therefor the attached Figures 1-7.

Signed and Sealed this

Thirty-first Day of January, 1995

*Attest:*

Bruce Lehman

BRUCE LEHMAN

*Attesting Officer*

*Commissioner of Patents and Trademarks*

US005348120A

United States Patent [19]

Junk et al.

[11] Patent Number: 5,348,120

[45] Date of Patent: Sep. 20, 1994

[54] RAIL LUBRICATION APPARATUS

[75] Inventors: Ronald K. Junk, Cabot; William T. Urmson, Jr., Valencia; Thomas R. Walker, Mars, all of Pa.

[73] Assignee: Portec Inc., Oak Brook, Ill.

[21] Appl. No.: 995,546

[22] Filed: Dec. 22, 1992

Related U.S. Application Data

[63] Continuation of Ser. No. 687,360, Apr. 18, 1991, abandoned.

[51] Int. Cl.[5] ..... B61K 3/00

[52] U.S. Cl. ..... 184/3.1; 104/279; 238/338; 248/228

[58] Field of Search ..... 184/2, 3.1, 3.2; 104/279; 198/500; 238/338; 246/169 R, 193, 249; 248/228, 316.1

[56] References Cited

U.S. PATENT DOCUMENTS

| | | | |
|---|---|---|---|
| 843,918 | 2/1907 | Wallace | 238/338 |
| 1,489,104 | 4/1924 | Armington | 248/228 |
| 1,707,016 | 3/1929 | Keim | 104/279 |
| 1,880,672 | 10/1932 | Bates et al. | 184/3.1 |
| 1,888,678 | 11/1932 | Keim | 184/3.1 |
| 1,979,307 | 11/1934 | Bates | 184/3.1 |
| 2,168,554 | 8/1939 | Bates | 184/3.1 |
| 2,168,577 | 8/1939 | Overmier et al. | 184/3.1 |
| 2,183,727 | 12/1939 | Stern | 184/3.1 |
| 2,223,714 | 12/1940 | Bates et al. | 184/3.1 |
| 2,231,394 | 2/1941 | Reece | 184/3.1 |
| 2,285,082 | 6/1942 | Bolt | 184/3.1 |
| 2,664,113 | 12/1953 | Dodge | 248/228 |
| 2,884,093 | 4/1959 | Stewart | 184/3.1 |
| 2,929,466 | 3/1960 | McWilliams | 184/3.1 |
| 3,147,822 | 9/1964 | Watts | 184/3.1 |
| 3,210,539 | 10/1965 | Malaquin | 246/249 |

FOREIGN PATENT DOCUMENTS

| | | | |
|---|---|---|---|
| 0622686 | 10/1962 | Belgium | 184/3.1 |
| 1244228 | 7/1967 | Fed. Rep. of Germany | 238/338 |

*Primary Examiner*—Ira S. Lazarus
*Assistant Examiner*—Alan B. Cariaso
*Attorney, Agent, or Firm*—Kirkpatrick & Lockhart

[57] ABSTRACT

A rail lubrication apparatus of the type used with a rail having a base with outwardly extending flanges, a head, and a web connecting the base and the head, is comprised of a wiping bar and a first set of clamps for maintaining the wiping bar in position with respect to the rail. The lubrication apparatus also comprises a pump actuator and a second set of clamps for maintaining the pump actuator in position with the rail. The rail lubrication apparatus may be used with a pump, responsive to the pump actuator, for pumping a lubricant from a reservoir to the wiping bar to form a complete rail lubrication system. The clamps, wiping bar, and pump actuator are each of a unique construction.

2 Claims, 6 Drawing Sheets

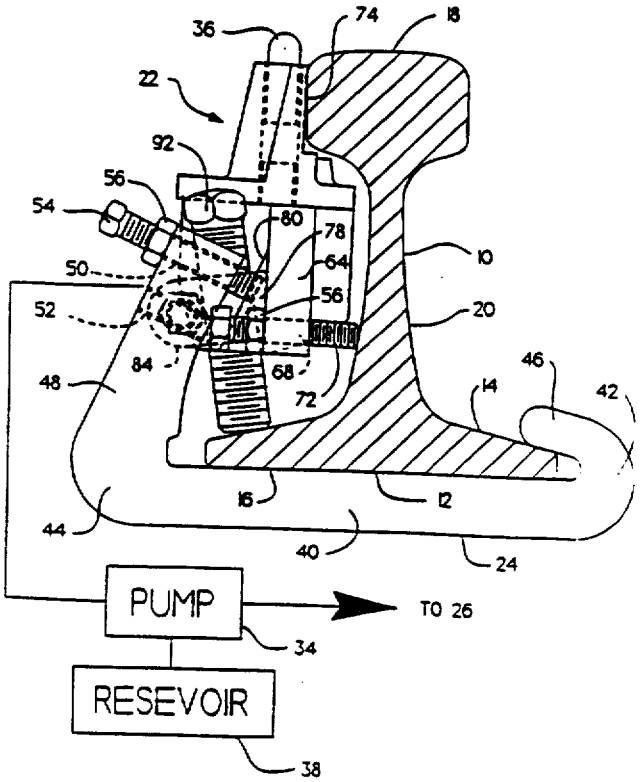

UNITED STATES PATENT AND TRADEMARK OFFICE

CERTIFICATE OF CORRECTION

PATENT NO. : 5,348,120

DATED : September 20, 1994

INVENTOR(S) : Ronald K. Junk, William T. Urmson, Jr. and Thomas R. Walker

It is certified that error appears in the above-indentified patent and that said Letters Patent is hereby corrected as shown below:

Col. 5, line 46, delete "FIGURES" and substitute therefor --FIGURE--.

Col. 8, line 37, delete "these" and substitute therefor --those--.

Col. 8, line 51, delete "peri,it" and substitute therefor --permit--.

Col. 10, line 1, delete "rial" and substitute therefor --rail--.

Col. 10, line 11, delete "rial" and substitute therefor --rail--.

Col. 10, line 55, delete "slide" and substitute therefor --slid--.

Col. 11, line 5, delete ";" and substitute therefor --:--.

Col 12, line 2, delete "of" and substitute therefor --to--.